US008651636B2

(12) United States Patent
Yamamoto et al.

(10) Patent No.: US 8,651,636 B2
(45) Date of Patent: Feb. 18, 2014

(54) LIQUID DROPLET EJECTION APPARATUS

(71) Applicant: Brother Kogyo Kabushiki Kaisha, Nagoya (JP)

(72) Inventors: Jiro Yamamoto, Nagoya (JP); Masayuki Takata, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/765,811

(22) Filed: Feb. 13, 2013

(65) Prior Publication Data

US 2013/0258003 A1 Oct. 3, 2013

(30) Foreign Application Priority Data

Mar. 28, 2012 (JP) ..... 2012-073032

(51) Int. Cl.
*B41J 2/19* (2006.01)

(52) U.S. Cl.
USPC ..... 347/85; 347/92

(58) Field of Classification Search
USPC ..... 347/84, 85, 86, 87, 92
See application file for complete search history.

(56) References Cited

U.S. PATENT DOCUMENTS

| | | | | |
|---|---|---|---|---|
| 6,390,611 | B1 * | 5/2002 | Kobayashi et al. | 347/84 |
| 7,384,136 | B2 * | 6/2008 | Takagi et al. | 347/86 |
| 7,452,065 | B2 * | 11/2008 | Ogawa | 347/92 |
| 7,661,805 | B2 * | 2/2010 | Usui | 347/92 |
| 2005/0088494 | A1 | 4/2005 | Shimizu et al. | |
| 2008/0018699 | A1 | 1/2008 | Shimizu | |

FOREIGN PATENT DOCUMENTS

| | | |
|---|---|---|
| JP | 2005/161770 | 6/2005 |
| JP | 2008/018589 | 1/2008 |

* cited by examiner

*Primary Examiner* — Anh T. N. Vo
(74) *Attorney, Agent, or Firm* — Frommer Lawrence & Haug LLP

(57) ABSTRACT

A liquid droplet ejection apparatus includes: a plurality of discharge openings for discharging bubbles in liquid supply flow passages supplying liquid from liquid chambers to a liquid droplet ejection head, for each of the liquid chambers; a first opening and closing section being capable of opening and closing the discharge openings; and a first pushing section causing the discharge openings to be opened and closed by moving the first opening and closing section. The first opening and closing section includes a plurality of first cover portions that can cover each of the discharge openings, a first contact portion corresponding to the first pushing section and common to the first cover portions, and a first connecting portion connecting the first cover portions with the first contact portion.

15 Claims, 7 Drawing Sheets

LIQUID DROPLET EJECTION APPARATUS

CROSS-REFERENCE TO RELATED APPLICATIONS

This non-provisional application claims priority under 35 U.S.C. §119(a) on Patent Application No. 2012-073032 filed in Japan on Mar. 28, 2012, the entire contents of which are hereby incorporated by reference.

TECHNICAL FIELD

The present invention relates to a liquid droplet ejection apparatus for forming an image by ejecting liquid droplet onto a recording medium.

BACKGROUND

A liquid droplet ejection apparatus for ejecting ink from an ejection head provided in the liquid droplet ejection apparatus and forming an image on a recording medium by the ink impinging on the recording medium such as a paper has been conventionally known. The liquid droplet ejection apparatus supplies the ink from an ink tank for storing the ink to the ejection head through a tube. If there are bubbles in the ink at supplying the ejection head with the ink, it is difficult to eject the ink, thereby reducing the recording quality of the recording medium. Therefore, it is necessary to remove bubbles that entered a passage (hereinafter, called as "a liquid supply flow passage") for flowing liquid from the ink tank to the ejection head. As a structure of removing bubbles that entered the liquid supply flow passage, a structure described in Japanese Patent Application Laid-Open No. 2008-18589 has been known. In the structure described in Japanese Patent Application Laid-Open No. 2008-18589, a bubble storage chamber for storing bubbles is provided in the liquid supply flow passage and the bubbles stored in the bubble storage chamber are discharged to an outside of the bubble storage chamber by a vacuum pump. In the structure described in Japanese Patent Application Laid-Open No. 2008-18589, a valve is provided in a passage hole for connecting the bubble storage chamber and the outside. The valve changes its position along the passage hole. The valve is positioned at a position of opening the passage hole if discharging the bubble storage chamber, while the valve is positioned at a position of covering the passage hole if not discharging the bubble storage chamber. The opening and closing of the bubble storage chamber is performed by the valve.

SUMMARY

In the structure described in Japanese Patent Application Laid-Open No. 2008-18589, since an inserting body being in contact with the valve is provided and the valve changes its position by raising and lowering the inserting body, it is necessary to provide one inserting body corresponding to one valve. Therefore, if the number of valves is increased due to the increase in the number of liquid supply flow passages, it is necessary to increase the number of inserting bodies accordingly. In the structure described in Japanese Patent Application Laid-Open No. 2008-18589, it is necessary to provide four inserting bodies corresponding to four liquid supply flow passages because there are four liquid supply flow passages corresponding to four colors of black BK, yellow Y, cyan C and magenta M. If the number of inserting bodies is increased, a problem occurs in that a structure for operating the inserting bodies becomes complicated due to the increase in the number of parts.

An object is to solve the problem and provide a liquid droplet ejection apparatus for performing, by a simplified structure, the opening and closing of a passage for discharging bubbles that entered the liquid supply flow passage.

As a means for achieving the object, a liquid droplet ejection apparatus according to a first aspect is a liquid droplet ejection apparatus for ejecting liquid droplet from a liquid droplet ejection head, comprising: a plurality of liquid chambers configured to store liquid; a plurality of liquid supply flow passages configured to supply the liquid from the liquid chambers to the liquid droplet ejection head; a plurality of discharge openings provided at each of the liquid chambers and configured to discharge bubbles in the liquid supply flow passages; a first opening and closing section which is able to open and close the discharge openings, and which includes a plurality of first cover portions being able to cover each of the discharge openings, a first contact portion common to and corresponding to the first cover portions, and a first connecting portion connecting the first cover portions with the first contact portion; and a first pushing section configured to push the first contact portion to open and close the discharge openings by moving the first opening and closing section.

According to this configuration, the first opening and closing section can open and close a plurality of discharge openings by only pushing the first contact portion of the first opening and closing section while covering the plurality of discharge openings. Therefore, as compared with a case of providing a plurality of pushing sections for pushing opening and closing sections to open and close them corresponding to the plurality of discharge openings, respectively, this configuration can reduce the number of the pushing sections for pushing the opening and closing sections. Therefore, an operation of opening and closing the discharge openings for discharging bubbles that entered the liquid supply flow passage is performed by a simplified structure.

The above and further objects and features will more fully be apparent from the following detailed description with accompanying drawings.

DETAILED DESCRIPTION

Figure 1:
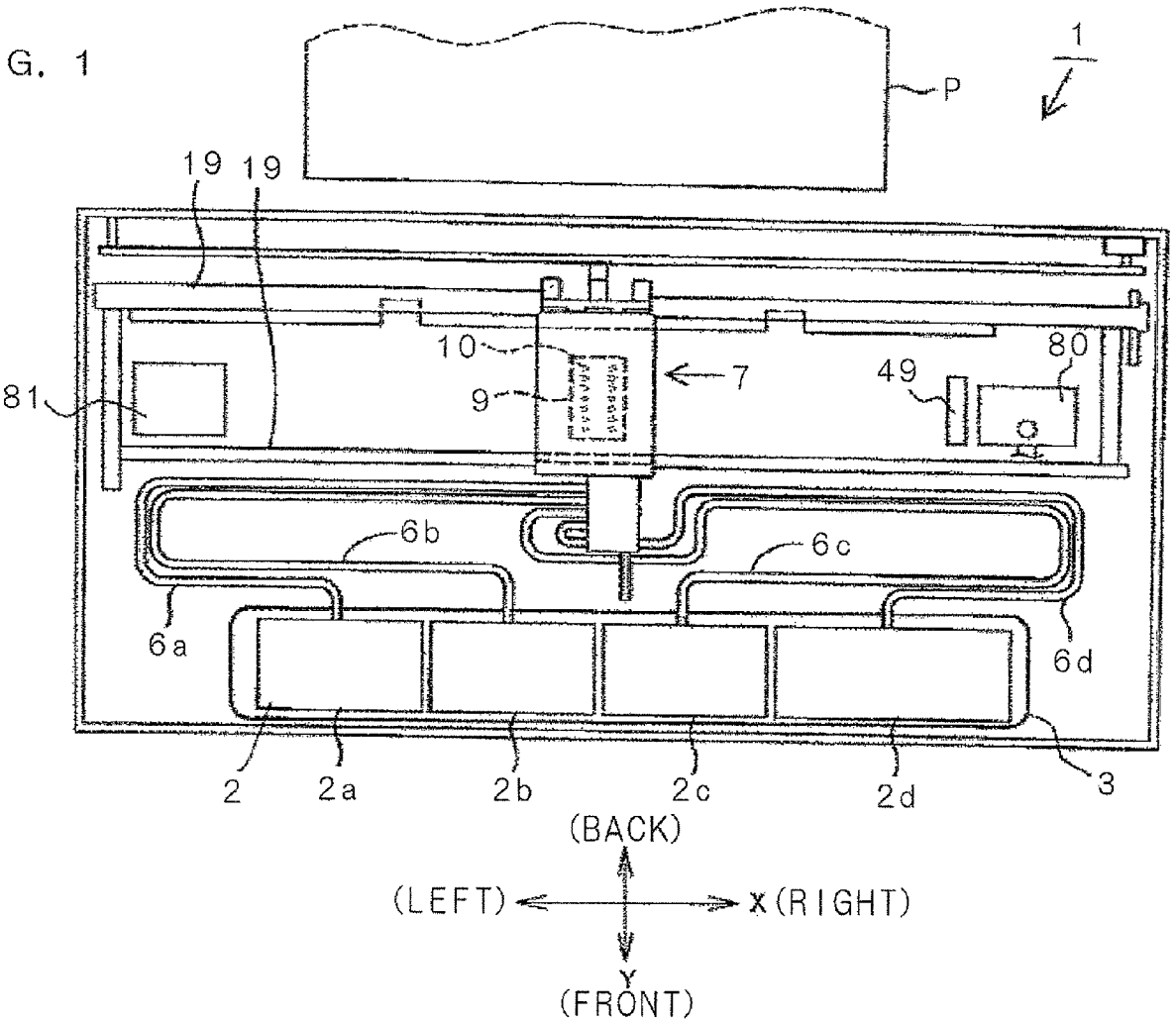
FIG. 1 is a plan view of an ink jet printer.

Next, an embodiment is described below with reference to the drawings. In the following description, the direction and side in which ink is ejected onto a recording medium are the downward direction and lower side, respectively. The opposite direction and side are the upward direction and upper side, respectively. In addition, the scanning direction (X direction) of a head holder 7 in FIG. 1 is the left-right direction. A direction perpendicular to the scanning direction (Y direction) is the front-back direction.

A structure of an ink jet printer 1 is described with reference to FIG. 1. In the ink jet printer 1, ink is supplied from an ink cartridge 2 for storing the ink mounted to be exchangeable on a mounting section 3 to a recording head 9 mounted on the head holder 7 also having a function as a carriage, whose shape is substantially a box shape. The head holder 7 is attached to two guide shafts 19 arranged in parallel with each other so as to be slidable. The head holder 7 moves in the scanning direction (the left-right direction, X direction), a recording medium P moves in the direction (Y direction) perpendicular to the scanning direction, and the ink is ejected from a plurality of nozzles 10 of the recording head 9, thereby performing printing of data on the recording medium P.

The ink cartridge 2 (individually shown by 2*a*, 2*b*, 2*c*, 2*d*) stores, for example, ink of each color of magenta M, cyan C, yellow Y and black BK. The ink cartridge 2 is connected with one end of an ink supply tube 6 (individually shown by 6*a*, 6*b*, 6*c*, 6*d*) as a passage through which ink of a predetermined color flows. The ink of a predetermined color is supplied to the recording head 9.

In the present embodiment, dye ink is used as color ink of magenta M, cyan C and yellow Y, while pigment ink is used as ink of black BK. The dye ink is suitable for printing an image such as a photograph because the dye ink has fine particles and high color development. On the other hand, characters having sharp edges can be recorded on a recording medium by using the pigment ink because it is unlikely to cause a blur on the recording medium. Therefore, in the present embodiment, color ink mainly used for forming an image such as a photograph is the dye ink and black ink mainly used for forming characters is the pigment ink. However, the selection of dye and pigment for each color ink is not limited by this.

A maintenance section 80 is arranged at one end of the left-right direction (X direction) of the ink jet printer 1 and in the lower direction of the two guide shafts 19 so as to absorb ink in the nozzles 10 for preventing the ink from not being ejected. A well-known wiper 49 is arranged at a side of the maintenance section 80 to wipe out and clean a nozzle face of the recording head 9. A flushing receiving section 81 is arranged at the other end of the left-right direction (X direction) of the ink jet printer 1 so as to periodically or forcibly eject ink from the nozzles 10 of the recording head 9 and prevent the ink from not being ejected. The maintenance section 80 will be described later in detail.

Figure 2:
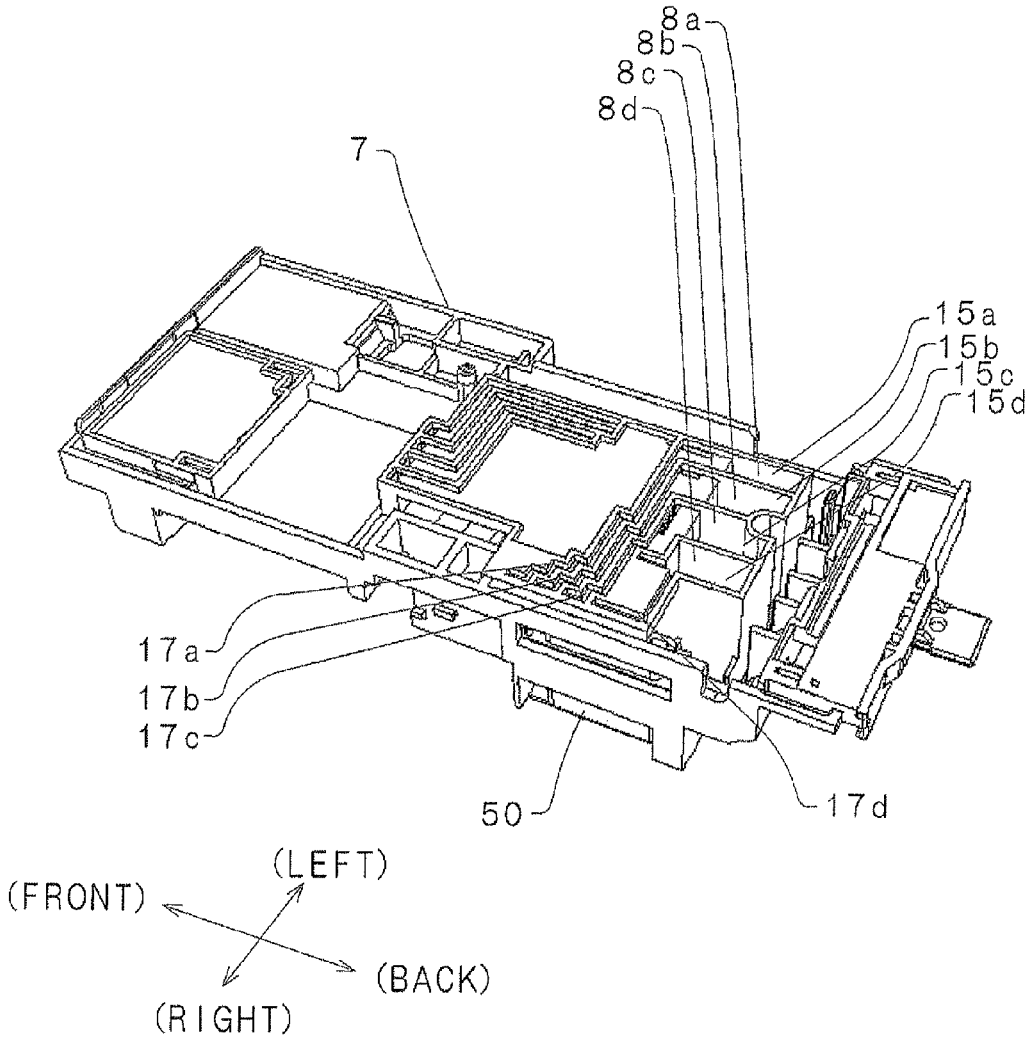
FIG. 2 is a perspective view of a head holder.
Figure 3:
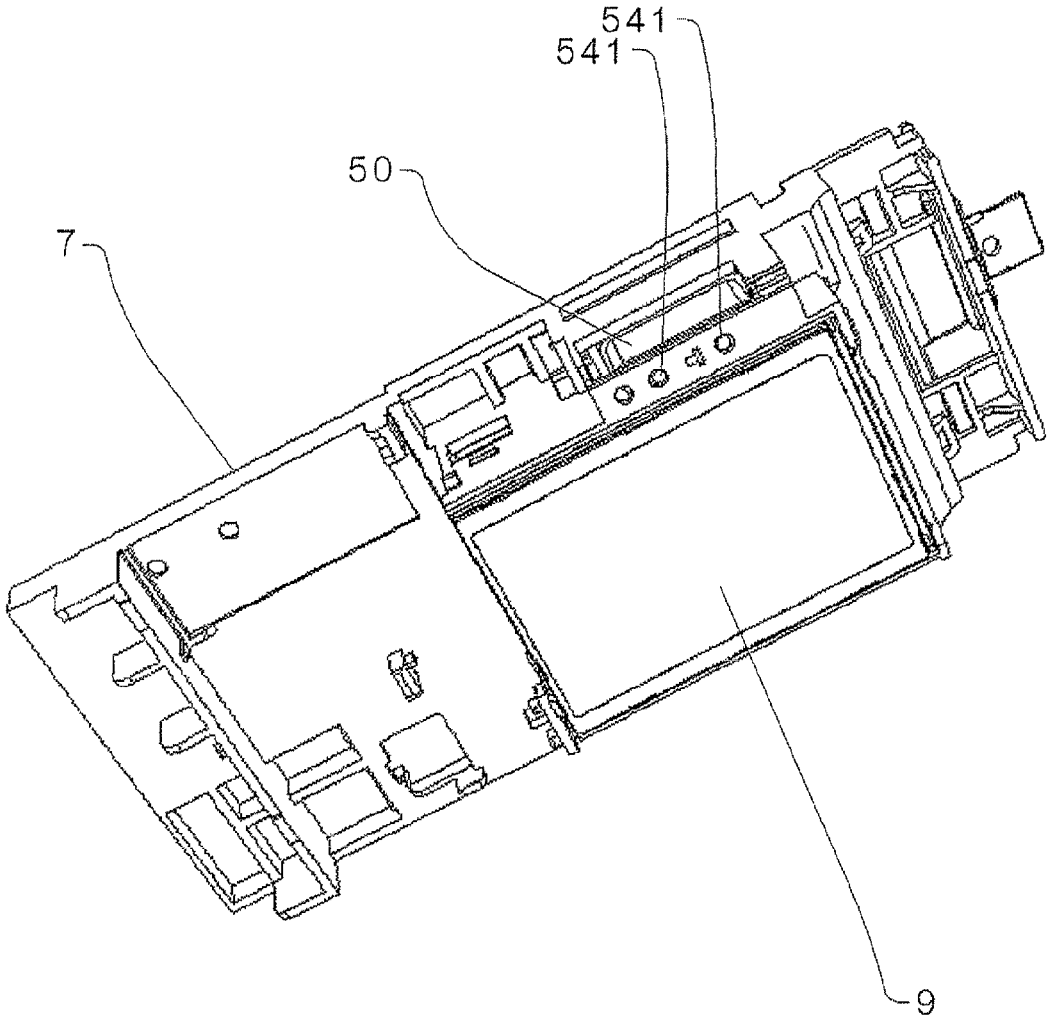
FIG. 3 is a perspective view of a head holder.
Figure 3:
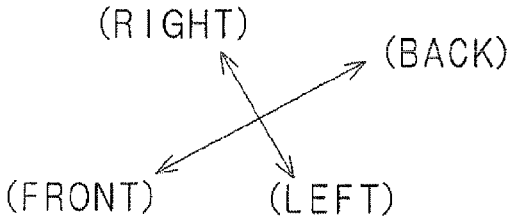
Figure 4:
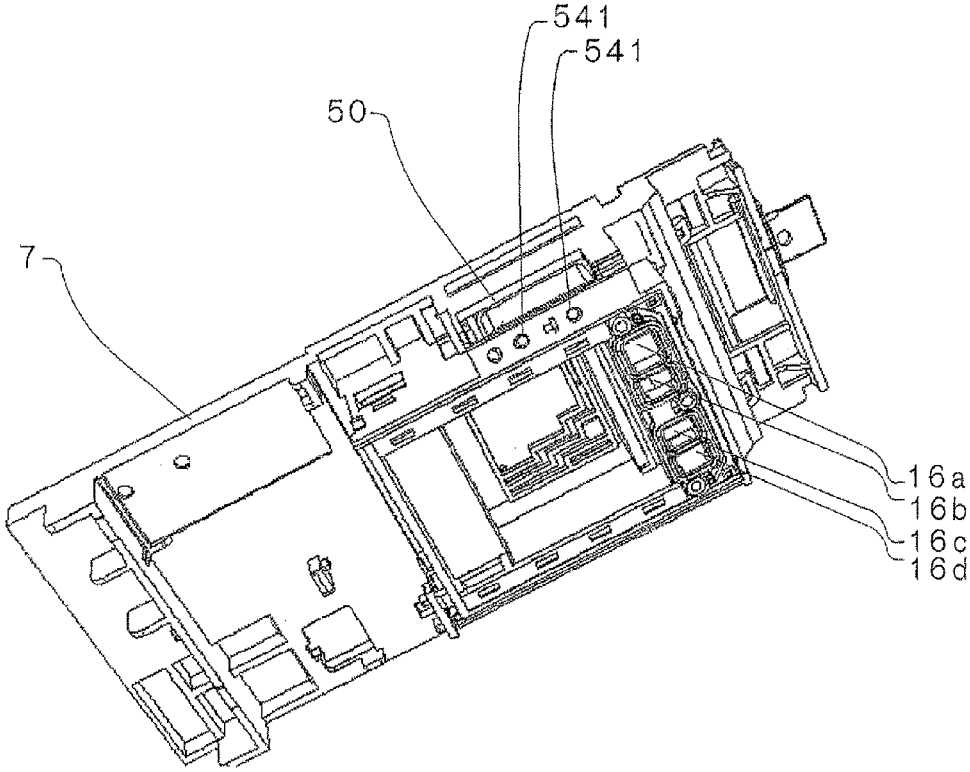
FIG. 4 is a perspective view of a head holder obtained by removing a storage head from FIG. 3.
Figure 4:
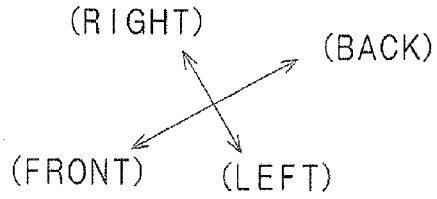

As illustrated in FIGS. 2-4, the recording head 9 including the nozzles 10 arranged for each ink color is fixed to a bottom of the head holder 7. The head holder 7 includes a buffer tank 8 (individually shown by 8*a*, 8*b*, 8*c*, 8*d*) having a buffer chamber 15 (individually shown by 15*a*, 15*b*, 15*c*, 15*d*) arranged for each ink color above the head holder 7, and an opening and closing section 50 adjacent to a side of the buffer tank 8. The bottom of the head holder 7 is opened so as to expose a nozzle face 29 arranged at the lowest face and having the nozzles 10 of the recording head 9 formed thereon. The recording head 9 is formed by laminating and attaching a plurality of plates, and a cavity unit 11 supplied with each ink from the buffer tank 8 is attached to a piezoelectric actuator having a plate shape and including a piezoelectric deformation section. Flexible wires for mounting a driving circuit are arranged on an upper face of the recording head 9 and are electrically connected with each other. Although it is not illustrated in the drawings, the plurality of nozzles 10 for ejecting ink for each ink color are arranged on the nozzle face 29 of the lowest face of the cavity unit 11 and in the scanning direction (X direction) of the head holder 7. Since a printing data signal from the driving circuit selectively deforms the piezoelectric deformation section, ink is ejected from the nozzles 10 corresponding to the printing signal. Each ink is supplied from the buffer tank 8 to an inside of the cavity unit 11 and each of the nozzles 10 because an ink supply hole 12 is provided for each ink in the cavity unit 11.

Next, the buffer tank 8 is described with reference to FIGS. 2-4.

As illustrated in FIGS. 2-4, the buffer tank 8 includes the buffer chamber 15 (individually shown by 15*a*, 15*b*, 15*c*, 15*d*) divided for each color ink and is made of synthetic resin material. One end of the buffer tank 8 is connected with point ends of ink supply tubes 6*a*-6*d* arranged for each color. Each ink supplied from the ink cartridge 2 is stored in the buffer chamber 15 via a passage for supplying ink. After floating and separating bubbles of the ink in the buffer chamber 15, the ink stored in the buffer chamber 15 is supplied to the ink supply hole 12 of the recording head 9 via outlet sections 16*a*-16*d* downwardly formed at a bottom side of the buffer tank 8.

As illustrated in FIGS. 2-4, ends of suction passages 17*a*-17*d* which are used as passages for suctioning ink together with air are connected with the buffer chamber 15 above the buffer chamber 15. Other ends of the suction passages 17*a*-17*d* are connected with discharge openings 18*a*-18*d* which are opened in the outside direction, thereby discharging bubbles to the outside via the discharge openings 18*a*-18*d*. Since the air stored in the buffer chambers 15*a*-15*d* is discharged from an upper portion of the buffer tank 8, bubbles do not flow into the recording head 9 whose position is relatively lower than that of the buffer tank 8. Therefore, a passage for flowing ink, which is arranged in the recording head 9, is not blocked with the bubbles. The suction passages 17*a*-17*d* are formed between a groove portion formed on an upper face of the buffer chamber 15 and a membrane for covering and attaching the groove portion, such as a film (not shown) made of synthetic resin.

Next, the opening and closing section 50 is described with reference to FIGS. 5-7.

The opening and closing section 50 adjacent to one side of the buffer tank 8 is provided in the head holder 7 made of synthetic resin. The opening and closing section 50 includes the first opening and closing section 51 corresponding to and provided in the discharge openings 18*a*, 18*b*, 18*c* connected with the buffer chambers 15*a*, 15*b*, 15*c* for storing ink of magenta M, cyan C and yellow Y, respectively, the second opening and closing section 52 corresponding to and provided in the discharge opening 18*d* connected with the buffer chamber 15*d* for storing ink of black BK, and a cover section 54 for covering the first to second opening and closing sections 51, 52. The cover section 54 is integrally formed with the head holder 7.

The first opening and closing section 51 includes first cover portions 511 provided in a position for simultaneously covering the discharge openings 18*a*, 18*b*, 18*c* corresponding to magenta M, cyan C and yellow Y, respectively, the first contact portion 513 provided in a position for contacting with an exhaust rod 75 described later, and the first connecting portion 512 for connecting the first cover portions 511 with the first contact portion 513. The first opening and closing section 51 is supported by a shaft section 53 provided in the first connecting portion 512. The first opening and closing section 51 rotates around the shaft section 53. The second opening and closing section 52 includes the second cover portion 521 provided in a position for covering the discharge opening 18*d* (BK), the second contact portion 523 provided in a position for contacting with the exhaust rod 75 described later, and the second connecting portion 522 for connecting the second cover portion 521 with the second contact portion 523. In similar to the first opening and closing section 51, the second connecting portion 522 of the second opening and closing section 52 is supported by the shaft section 53. The second opening and closing section 52 rotates around the shaft section 53. Since one shaft section 53 serves as each shaft section of the first to second opening and closing sections 51, 52, a structure of forming a shaft section is simplified in compared with a case that the shaft section is provided in the first to second opening and closing sections 51, 52, respectively.

A spring 55 such as a coil spring is compressed and positioned between a face opposite to a face contacting with the discharge openings 18*a*-18*c* in the first cover portions 511 of the first opening and closing section 51 and a face opposite to a face contacting with the exhaust rod 75 in the second contact portion 523 of the second opening and closing section 52. The spring 55 pushes the first opening and closing section 51 in a direction of closing the discharge openings 18*a*-18*c* by the first opening and closing section 51, while pushing the second opening and closing section 52 in a direction of closing the discharge opening 18*d* by the second opening and closing section 52. In such a state, since the first cover portions 511 are attached to surroundings of the discharge openings 18*a*-18*c* corresponding to magenta M, cyan C and yellow Y, the discharge openings 18*a*-18*c* corresponding to magenta M, cyan C and yellow Y are covered. In addition, since the second cover portion 521 is attached to surroundings of the discharge opening 18*d* corresponding to black BK, the discharge opening 18*d* is covered. The exhaust rod 75 described later is moved upwardly and pushes the first contact portion 513 in the upper direction against a biased force of the spring 55, so that the first opening and closing section 51 rotates around the shaft section 53 and the first cover portions 511 are separated from the discharge openings 18*a*-18*c*. That is, the discharge openings 18*a*-18*c* communicate with the atmosphere, so that bubbles are discharged to the outside. Since the first opening and closing section 51 rotates around the shaft section 53 provided in the first connecting portion 512, a structure of simultaneously opening and closing a plurality of discharge openings is simplified by only pushing one part corresponding to the first contact portion 513. Since the first to second opening and closing sections 51, 52 rotate around one or more shaft sections, a plurality of discharge openings opened and closed by the first to second opening and closing sections 51, 52 are opened and closed by a simplified structure.

A cover section 54 is formed as one portion of the head holder 7 and around the first to second opening and closing sections 51, 52 to cover them. The cover section 54 is provided with a shaft receiving section for supporting the shaft section 53, and openings 541 of the cover section 54 are formed in a region opposite to the first contact portion 513 and a region opposite to the second contact portion 523. Each size of the openings 541 is a size capable of receiving the exhaust rod 75. Each of the openings 541 is one portion of a passage for discharging ink and air stored in each of the buffer chambers 15*a*, 15*b*, 15*c*, 15*d*. Since the first to second opening and closing sections 51, 52 are covered by the cover section 54, the first to second opening and closing sections 51, 52 will not be in contact with a recording medium. Therefore, an opening and closing operation of the opening and closing section can be more reliably performed. Since the cover section 54 receives ink leaked from the discharge opening, it is possible to prevent the ink from being scattered to the outside.

Next, a structure of the maintenance section 80 is described with reference to FIG. 5. While the head holder 7 is stopped at a waiting position, the maintenance section 80 discharges and removes air stored in each of the buffer chambers 15*a*-15*d* via the suction passages 17*a*-17*d* that are passages for discharging bubbles, the discharge openings 18*a*-18*d*, the cover section 54 and the openings 541. The maintenance section 80 includes a cap 60 for absorbing and removing ink leaked to the outside direction at discharging and removing of the air.

The maintenance section 80 further includes lifting sections 70*a*, 70*b*. The cap 60 and the exhaust rod 75 are selectively moved in the upward or downward direction by driving the lifting sections 70*a*, 70*b*. As in a well known technique, the lifting sections 70*a*, 70*b* may be moved upwardly and downwardly by moving the head holder 7 to the waiting position or by using a driving source such as a motor. The maintenance section 80 further includes a suction pump 69 as a means for suctioning ink.

Figure 5:
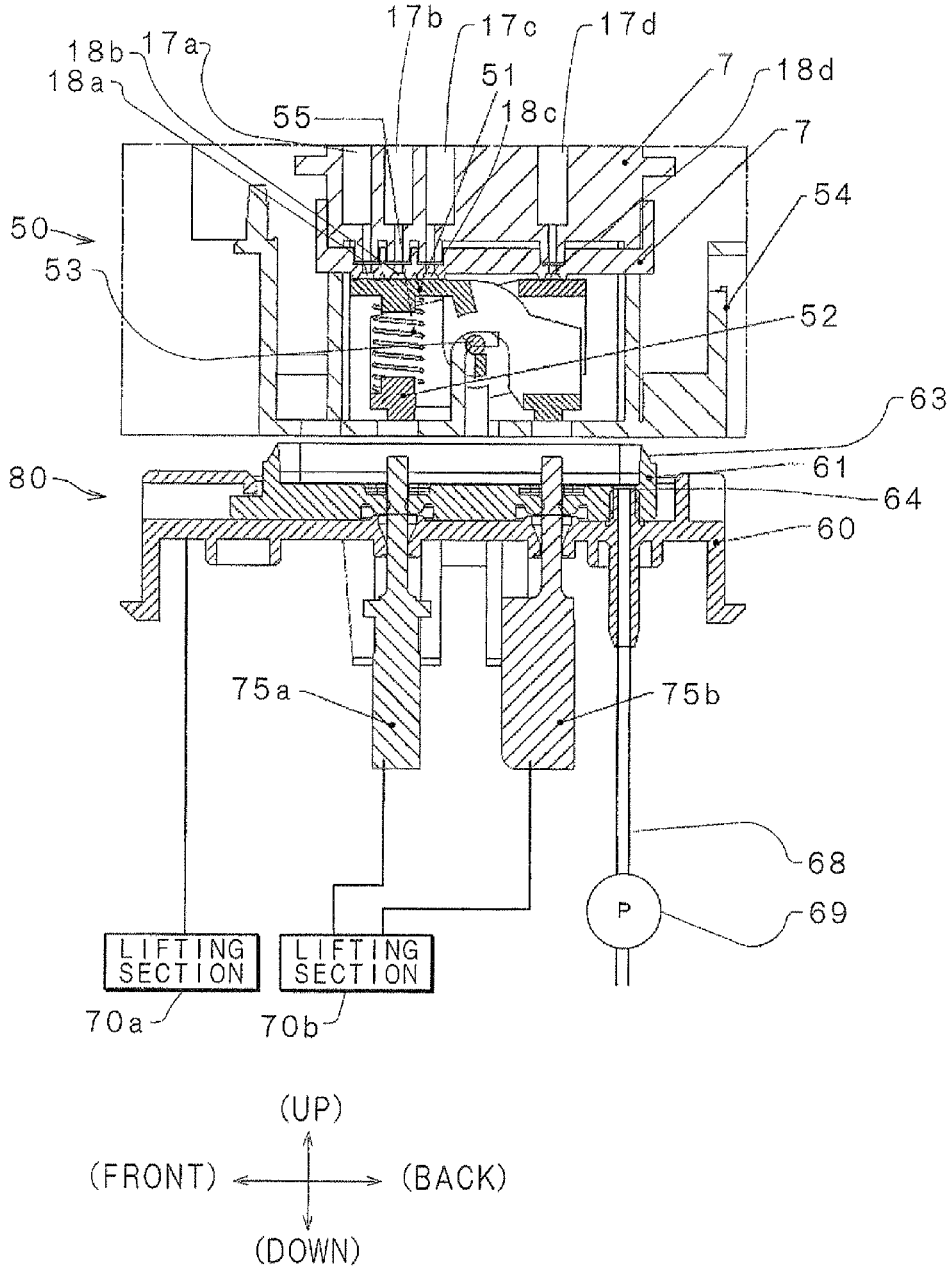
FIG. 5 is a Y direction sectional view of a head holder, an opening and closing section, and a maintenance section and a view of illustrating each different state.
Figure 6:
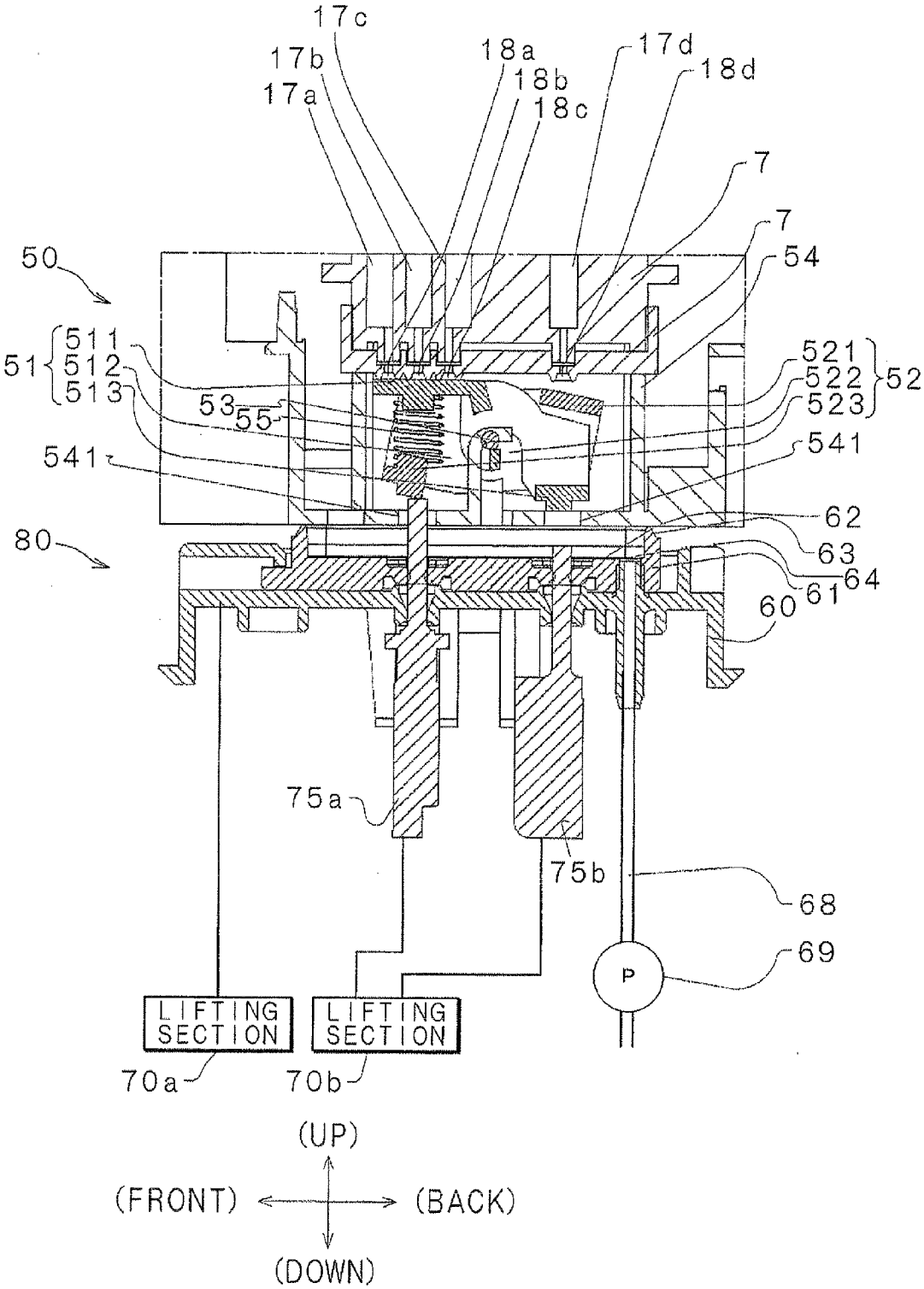
FIG. 6 is a Y direction sectional view of a head holder, an opening and closing section, and a maintenance section and a view of illustrating each different state.
Figure 7:
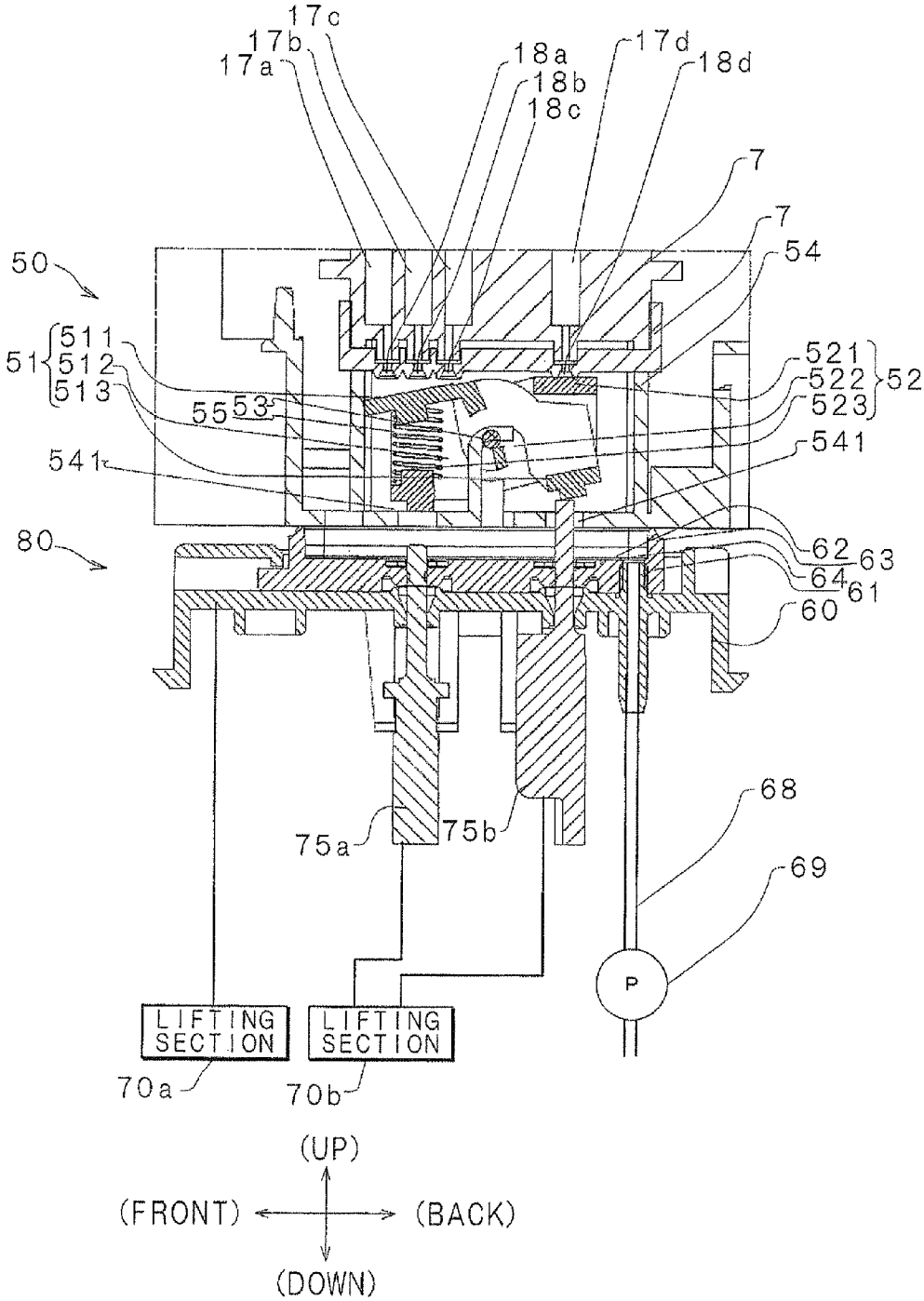
FIG. 7 is a Y direction sectional view of a head holder, an opening and closing section, and a maintenance section and a view of illustrating each different state.

As illustrated in FIGS. 5-7, the cap 60 further includes an exhaust cap 61 formed of a spring body for surrounding the openings 541 of the head holder 7 and being closely attached to the head holder 7 so as to separate the discharge openings 18*a*-18*d* from the surroundings thereof. The exhaust cap 61 includes a rip 63 vertically arranged around a bottom 62 and the edge of the bottom 62. The bottom 62 includes a hole 65 for penetrating the exhaust rod 75, and an exhaust opening 64. The exhaust opening 64 is connected with an exhaust tube 68. The exhaust tube 68 is connected with a suction pump 69 and waste ink discharged from the suction pump 69 is stored in a well-known waste ink reservoir (not shown). The rip 63 is attached to the surroundings of a lower end at each of the openings 541 of the head holder 7 so that the cap 60 can suction ink. Exhaust rods 75*a*, 75*b* protruding upward are arranged at the bottom of the exhaust cap 61, which can be in contact with the first to second opening and closing sections 51, 52. Since the exhaust rods 75*a*, 75*b* can selectively move in the upper or lower direction by the lifting section 70*b*, each of the exhaust rods 75*a*, 75*b* moves upwardly and selectively pushes the first to second opening and closing sections 51, 52 in the upper direction against the biased force of the spring 55, thereby opening the discharge openings 18*a*-18*c* and the discharge opening 18*d*, that is communicating the discharge openings 18*a*-18*c* and the discharge opening 18*d* with the atmosphere. The discharge openings 18*a*-18*c* and the discharge opening 18*d* are opened and the suction pump 69 is driven, so that bubbles in the buffer tank 8 are discharged to the waste ink reservoir (not shown) via a discharging passage.

Next, opening and closing operations of the first to second opening and closing sections 51, 52 are described with reference to FIGS. 5-7. FIG. 5 illustrates a state where the discharge openings 18*a*, 18*b* and 18*c* corresponding to ink of magenta M, cyan C and yellow Y, respectively, are covered as well as the discharge opening 18*d* corresponding to the ink of black BK. FIG. 6 illustrates a state where the discharge openings 18*a*, 18*b* and 18*c* corresponding to ink of magenta M, cyan C and yellow Y, respectively, are covered while the discharge opening 18*d* corresponding to the ink of black BK is opened. FIG. 7 illustrates a state where the discharge openings 18*a*, 18*b* and 18*c* corresponding to ink of magenta M, cyan C and yellow Y, respectively, are opened while the discharge opening 18*d* corresponding to the ink of black BK is covered.

The discharge openings 18*a*-18*d* are arranged in a straight line and a direction (Y direction) perpendicular to the scanning direction, that is the front-back direction. If the left-right direction in the drawings is the front-back direction, the discharge opening 18*a* corresponding to magenta M, the discharge opening 18*b* corresponding to cyan C, the discharge opening 18*c* corresponding to yellow Y, and the discharge opening 18*d* corresponding to black BK are sequentially arranged in the front-back direction. A distance from the discharge opening 18*a* corresponding to magenta M to the discharge opening 18*b* corresponding to cyan C is equal with a distance from the discharge opening 18*b* corresponding to cyan C to the discharge opening 18*c* corresponding to yellow Y. A distance from the discharge opening 18*c* corresponding to yellow Y to the discharge opening 18*d* corresponding to black BK is longer than the distance from the discharge opening 18*a* corresponding to magenta M to the discharge opening 18*b* corresponding to cyan C or the distance from the discharge opening 18*b* corresponding to cyan C to the discharge opening 18*c* corresponding to yellow Y. As a distance between discharge openings is more and more increased, color mixture of ink will not easily occur between the discharge openings.

With respect to a covering state of covering the discharge openings 18*a*-18*c* corresponding to magenta M, cyan C and yellow Y and an opening state of opening the discharge openings 18*a*-18*c* corresponding to magenta M, cyan C and yellow Y, one of the two states is selected by the opening and closing operation of the first opening and closing section 51. When the air stored in the buffer tanks 8*a*, 8*b* and 8*c* corresponding to magenta M, cyan C and yellow Y, respectively, is discharged, the first opening and closing section 51 is opened. The first opening and closing section 51 is opened such that the air stored in the buffer tanks 8*a*, 8*b* and 8*c* can be discharged with ink to the outside via the discharge openings 18*a*-18*c*.

With respect to a covering state of covering the discharge opening 18*d* corresponding to black BK and an opening state of opening the discharge opening 18*d* corresponding to black BK, one of the two states is selected by the opening and closing operation of the second opening and closing section 52. When the air stored in the buffer tank 8*d* corresponding to black BK is discharged, the second opening and closing section 52 is opened. The second opening and closing section 52 is opened such that the air stored in the buffer tank 8*d* can be discharged with ink to the outside via the discharge opening 18*d*.

When the air stored in the buffer tank 8 is not discharged, the first to second opening and closing section 51, 52 are closed. If the first to second opening and closing section 51, 52 are closed, each of the discharge openings 18*a*-18*d* is covered. Therefore, ink is not leaked from the discharge openings 18*a*-18*d* to the outside.

As described above, the first opening and closing section 51 is rotatably supported by the shaft section 53. Similarly, the second opening and closing section 52 is rotatably supported by the shaft section 53. The first cover portions 511 of the first opening and closing section 51 are provided at a side in close proximity to the discharge openings 18*a*-18*c* corresponding to magenta M, cyan C and yellow Y. The second cover portion 521 of the second opening and closing section 52 is provided at a side in close proximity to the discharge opening 18*d* corresponding to black BK. The spring 55 is provided between the first and second opening and closing sections 51, 52. The spring 55 is provided in a region of the first opening and closing section 51 of the first cover portion 511 side in relation to the shaft section 53 and a region of the second opening and closing section 52 of an opposite side to the second cover portion 521 side in relation to the shaft section 53.

The spring 55 is provided in each of the regions and the first opening and closing section 51 is biased by the spring 55, so that the first opening and closing section 51 rotates around the shaft section 53 in a direction of moving the first cover portions 511 upwardly. On the other hand, with respect to the second opening and closing section 52, the second opening and closing section 52 is biased by the spring 55, so that the second opening and closing section 52 rotates around the shaft section 53 in a direction of moving the second cover portion 521 upwardly. Since a passage for rotating the first opening and closing section 51 includes a face on which the discharge openings 18*a*-18*c* of the head holder 7 are formed, the rotation of the first opening and closing section 51 is stopped by the first opening and closing section 51 being in contact with the face having the discharge openings 18*a*-18*c*. Similarly, since a passage for rotating the second opening and closing section 52 includes a face on which the discharge opening 18*d* of the head holder 7 is formed, the rotation of the second opening and closing section 52 is stopped by the second opening and closing section 52 being in contact with the face having the discharge opening 18*d*.

When the rotation of the first opening and closing section 51 is stopped, the first cover portions 511 of the first opening and closing section 51 are pressed to the discharge openings 18*a*-18*c* corresponding to magenta M, cyan C and yellow Y by the spring 55. Similarly, when the rotation of the second opening and closing section 52 is stopped, the second cover portion 521 of the second opening and closing section 52 is pressed to the discharge opening 18*d* corresponding to black BK by the spring 55. That is, the first cover portions 511 cover the discharge openings 18*a*-18*c* corresponding to magenta M, cyan C and yellow Y, while the second cover portion 521 covers the discharge opening 18*d* corresponding to black BK. The opening and closing sections are biased by a biasing section such as the spring 55 such that each of the opening and closing sections is positioned on a cover position. Therefore, the cover of the discharge openings can more reliably be performed by the opening and closing sections. In addition, since the first to second opening and closing sections 51, 52 are biased by one biasing section, a structure of the biasing section is simplified as compared with the case of providing the biasing section in each of the first to second opening and closing sections 51, 52. When the first opening and closing section 51 is moved to a position of opening the discharge openings 18*a*-18*c*, the second opening and closing section 52 is biased by the biasing section in a direction of moving the second opening and closing section 52 to a position of covering the discharge opening 18*d*. On the other hand, when the second opening and closing section 52 is moved to a position of opening the discharge opening 18*d*, the first opening and closing section 51 is biased by the biasing section in a direction of moving the first opening and closing section 51 to a position of covering the discharge openings 18*a*-18*c*. Therefore, one of the first to second opening and closing sections 51, 52 is moved to a position of opening the discharge opening, while the other of the first to second opening and closing sections 51, 52 is reliably moved to a position of covering the discharge opening.

Next, to discharge bubbles stored in the buffer tank 8*d* corresponding to black BK, an operation of opening the discharge opening 18*d* corresponding to black BK is described.

To open the discharge opening 18*d* corresponding to black BK, the lifting section 70*a* moves the cap 60 in the upper direction such that the rip 63 provided at the exhaust cap 61 of the cap 60 is closely attached to the surroundings of the lower end at each of the openings 541 of the head holder 7. In a state that the rip 63 is closely attached to the surroundings of each of the openings 541 of the head holder 7, the lifting section 70*b* moves the exhaust rod 75*a* in the upper direction. The exhaust rod 75*a* passes through the opening 541 and contacts with the second contact portion 523 of the second opening and closing section 52. After contacting the exhaust rod 75*a* with the second contact portion 523, the lifting section 70*b* further moves the exhaust rod 75*a* in the upper direction. A force of moving the exhaust rod 75*a* in the upper direction by the lifting section 70*b* is larger than that of moving the second contact portion 523 of the second opening and closing section 52 in the lower direction by the spring 55. Therefore, the second contact portion 523 of the second opening and closing section 52 is moved to the upper direction against the biased force of the spring 55. The second contact portion 523 is moved to the upper direction, so that the second opening and closing section 52 rotates around the shaft section 53 and the second cover portion 521 is moved to the lower direction. That is, the second cover portion 521 is moved to a direction away from the discharge opening 18*d* corresponding to black BK. As the second cover portion 521 is moved to the direction away from the discharge opening 18*d*, so that the discharge opening 18*d* corresponding to black BK is opened to generate a passage for discharging air stored in the buffer tank 8*d*. Thereafter, the air stored in the buffer tank 8*d* is discharged by driving the suction pump 69. The air is discharged from the discharge opening 18*d* with ink by driving the suction pump 69. However, since the cover section 54 arranged around the second opening and closing section 52 surrounds the discharge opening 18*d*, the ink discharged from the discharge opening 18*d* is received by an inner wall of the cover section 54, thereby preventing ink from scattering to the outside.

When the second opening and closing section 52 is moved to a position of opening the discharge opening 18*d*, the first opening and closing section 51 is biased by the spring 55 in a direction of moving to a position of covering the discharge openings 18*a*-18*c*. Therefore, when the second opening and closing section 52 is moved to the position of opening the discharge opening 18*d*, the first opening and closing section 51 can reliably move to the position of covering the discharge openings 18*a*-18*c*.

When the discharge of air from the buffer tank 8*d* corresponding to black BK is stopped, the lifting section 70*b* moves the exhaust rod 75*a* in the lower direction after stopping the driving of the suction pump 69. Then, the exhaust rod 75*a* is moved to the lower direction. When the exhaust rod 75*a* is separated from the second opening and closing section 52, the second opening and closing section 52 covers the discharge opening 18*d* corresponding to black BK by the biased force of the spring 55.

Next, an operation of opening the discharge openings 18*a*-18*c* corresponding to magenta M, cyan C and yellow Y is described, which is to discharge bubbles stored in the buffer tanks 8*a*-8*c* corresponding to magenta M, cyan C and yellow Y. The operation of opening the discharge openings 18*a*-18*c* corresponding to magenta M, cyan C and yellow Y is performed after performing the operation of opening the discharge opening 18*d* corresponding to black BK as described above.

In a state that the rip 63 is closely attached to the surroundings of each of the openings 541 of the head holder 7, the lifting section 70*b* moves the exhaust rod 75*b* in the upper direction. The exhaust rod 75*b* passes through the opening 541 and contacts with the first contact portion 513 of the first opening and closing section 51. After contacting the exhaust rod 75*b* with the first contact portion 513, the lifting section 70*b* further moves the exhaust rod 75*b* in the upper direction. A force of moving the exhaust rod 75*b* in the upper direction by the lifting section 70*b* is larger than that of moving the first contact portion 513 of the first opening and closing section 51 in the lower direction by the spring 55. Therefore, the first contact portion 513 of the first opening and closing section 51 is moved to the upper direction against the biased force of the spring 55. As the first contact portion 513 is moved to the upper direction, the first opening and closing section 51 rotates around the shaft section 53 and the first cover portions 511 are moved to the lower direction. That is, the first cover portions 511 are moved to a direction away from the discharge openings 18*a*-18*c* corresponding to magenta M, cyan C and yellow Y. The first cover portions 511 are moved to the direction away from the discharge openings 18*a*-18*c*, so that the discharge openings 18*a*-18*c* corresponding to magenta M, cyan C and yellow Y are opened to generate a passage for discharging the air stored in the buffer tanks 8*a*-8*c*. Thereafter, the air stored in the buffer tanks 8*a*-8*c* is discharged by driving the suction pump 69. The air is discharged from the discharge openings 18*a*-18*c* together with ink by driving the suction pump 69. However, since the cover section 54 arranged around the first opening and closing section 51 surrounds the discharge openings 18*a*-18*c*, the ink discharged from the discharge openings 18*a*-18*c* is received by the inner wall of the cover section 54, thereby preventing the ink from scattering to the outside.

When the first opening and closing section 51 is moved to a position of opening the discharge openings 18*a*-18*c*, the second opening and closing section 52 is biased by the spring 55 in a direction of moving to a position of covering the discharge opening 18*d*. Therefore, when the first opening and closing section 51 is moved to the position of opening the discharge openings 18*a*-18*c*, the second opening and closing section 52 can reliably move to the position of covering the discharge opening 18*d*.

When the discharge of the air from the buffer tanks 8*a*-8*c* corresponding to magenta M, cyan C and yellow Y is stopped, the lifting section 70*b* moves the exhaust rod 75*b* in the lower direction after stopping the driving of the suction pump 69. Then, the exhaust rod 75*b* is moved to the lower direction. When the exhaust rod 75*b* is separated from the first opening and closing section 51, the first opening and closing section 51 covers the discharge openings 18*a*-18*c* corresponding to magenta M, cyan C and yellow Y by the biased force of the spring 55. Thereafter, the lifting section 70*a* moves the exhaust cap 61 to the lower side and the discharging operations are completed by releasing the contact of the exhaust cap 61 with the head holder 7.

As described above, the first opening and closing section 51 can open and close the discharge openings 18*a*-18*c* corresponding to magenta M, cyan C and yellow Y by only pushing the first contact portion 513 of the first opening and closing section 51 while covering the discharge openings 18*a*-18*c* corresponding to magenta M, cyan C and yellow Y. Therefore, as compared with a case of providing pushing sections for pushing to open and close a plurality of opening and closing sections corresponding to the discharge openings 18*a*-18*c* for magenta M, cyan C and yellow Y, this configuration can reduce the number of the pushing sections for pushing the opening and closing sections. Therefore, an operation of opening and closing the discharge openings 18*a*-18*c* for discharging bubbles that entered the liquid supply flow passage can be performed by a simplified structure.

Since the first to second opening and closing sections 51, 52 are biased by one spring, a structure of the biasing section can be more simplified as compared with a case of providing a means for biasing the first to second opening and closing sections 51, 52 in each of them.

In the present embodiment, dye ink is used for the ink of magenta M, cyan C and yellow Y, while pigment ink is used for the ink of black BK. If the dye ink is mixed with the pigment ink, there is a possibility that the operations of opening and closing the first to second opening and closing sections 51, 52 are obstructed by the cohesion of pigment. However, in the present embodiment, the discharge openings 18*a*-18*c* corresponding to magenta M, cyan C and yellow Y which use the dye ink are opened and closed by an opening and closing section different from that for the discharge opening 18*d* corresponding to black BK which uses the pigment ink. Therefore, an operation of opening and closing the discharge openings 18*a*-18*c* corresponding to magenta M, cyan C and yellow Y and an operation of opening and closing the discharge opening 18*d* corresponding to black BK can be performed with different timings. Consequently, the dye ink is not mixed with the pigment ink by passing through the first to second opening and closing sections 51, 52. Accordingly, the first to second opening and closing sections 51, 52 can reliably be operated.

If the black ink is mixed with any other color ink, it has an increased effect as compared with the case with color ink other than the black ink. However, since the discharge openings 18*a*-18*c* connected with the buffer tanks 8*a*-8*c* for storing the color ink and the discharge opening 18*d* connected with the buffer tank 8*d* for storing the black ink are opened and closed by different opening and closing sections 51, 52, respectively, the black ink is not mixed with the color ink through the first to second opening and closing sections 51, 52. Consequently, it is possible to prevent the black ink from being mixed with the color ink.

In the present embodiment, a distance from the shaft section 53 to the discharge opening 18*c* corresponding to the ink of yellow Y is smaller than a distance from the shaft section 53 to each of the discharge openings 18*a*, 18*b* corresponding to the ink of magenta M and cyan C. With respect to an amount of change in a position of a contact portion due to rotation of an opening and closing section around the shaft section 53, it is smaller at a contact portion arranged in a position near the shaft section 53 than at a contact portion arranged in a position away from the shaft section 53. The contact portion arranged in the position near the shaft section 53 reliably covers the discharge opening 18 as compared with the contact portion arranged in the position away from the shaft section 53. The discharge opening 18*c* corresponding to the ink of yellow which has an increased effect of color mixing as compared with other colors is reliably covered as compared with the discharge openings 18*a*, 18*b* corresponding to other colors of ink. Therefore, it is possible to prevent other ink from entering the discharge opening 18*c* connected with a liquid chamber for storing the ink of yellow. Consequently, it is possible to prevent the ink of yellow which is easily affected by color mixture and has a high brightness from being mixed with other colors.

Modified Example

Next, modified examples adding various kinds of modifications to the present embodiment are described. In the present embodiment, the discharge openings 18*a*-18*d* are arranged in the order of magenta M, cyan C, yellow Y and Black BK. However, the arrangement of the discharge openings 18*a*-18*d* is not limited by this order.

In the present embodiment, the first opening and closing section 51 opens and closes the discharge openings 18*a*-18*c* corresponding to magenta M, cyan C and yellow Y, while the second opening and closing section 52 opens and closes the discharge opening 18*d* corresponding to black BK. However, an operation of opening and closing the discharge opening 18 performed by each of the first to second opening and closing sections 51, 52 is not limited by this. For example, the first opening and closing section 51 may open and close the discharge openings 18*a*, 18*b* corresponding to magenta M and cyan C, while the second opening and closing section 52 may open and close the discharge openings 18*c*, 18*d* corresponding to yellow Y and black BK.

Although the present embodiment provides two opening and closing sections corresponding to the first to second opening and closing sections 51, 52, the number of the opening and closing sections is not limited by two. One opening and closing section or more than two opening and closing sections may be provided. A structure of opening and closing all of the discharge openings 18*a*-18*d* by one opening and closing section may also be applied.

In the present embodiment, the discharge openings 18*a*-18*d* are arranged in a straight line and the front-back direction. However, the arrangement of the discharge openings 18*a*-18*d* is not limited by this. For example, the discharge openings 18*a*-18*d* may be arranged in the left-right direction. If the discharge openings 18*a*-18*d* are arranged in the left-right direction, a distance between the shaft section 53 and the discharge opening is equal with respect to each of the discharge openings 18*a*-18*d*, thereby equalizing a force of covering each of the discharge openings 18*a*-18*d*. Therefore, all of the discharge openings are reliably covered by the opening and closing section.

Although the spring 55 is provided between the first cover portions 511 of the first opening and closing section 51 and the second contacting portion 523 of the second opening and closing section 52 in the present embodiment, a position of providing the spring 55 is not limited by this. A plurality of springs 55 may also be provided.

In the present embodiment, a timing of opening the discharge openings 18*a*-18*c* corresponding to magenta M, cyan C and yellow Y is different from that of opening the discharge opening 18*d* corresponding to black BK. The timing of opening the discharge openings is different from each other such that an effect of color mixture can be reduced. However, the opening of the discharge openings 18*a*-18*c* corresponding to magenta M, cyan C and yellow Y and the opening of the discharge opening 18*d* corresponding to black BK may be performed at the same time. It is possible to reduce a discharging time by simultaneously opening the discharge openings.

An elastic force of the spring 55 may be arbitrarily selected. For example, as the elastic force of the spring 55, it is possible to use an elastic force having a strength not being capable of rotating the first opening and closing section 51 by the exhaust rod 75*b* in a state that the exhaust rod 75*a* moves in the upper direction and the discharge opening 18*d* is opened by rotating the second opening and closing section 52. In this case, when the discharge opening 18*d* is opened, the discharge openings 18*a*-18*c* will not be opened. Therefore, it is possible to prevent colors from being mixed with each other. Even if an elastic force having a strength not being capable of rotating the second opening and closing section 52 by the exhaust rod 75*a* is used in a state that the exhaust rod 75*b* moves in the upper direction and the discharge openings 18*a*-18*c* are opened by rotating the first opening and closing section 51, it is possible to have the same effect as described above.

With respect to the rotations of the first to second opening and closing sections 51, 52, a control section for controlling the rotation may be provided such that the first cover portions 511 are not closer to the second contact portion 523 (the second cover portion 521 is not closer to the first contact portion 513) than a predetermined distance in a direction that the first cover portions 511 are approaching the second contact portion 523 (a direction that the second cover portion 521 is approaching the first contact portion 513). For example, if the first cover portions 511 are arranged in the lower direction while they are opened, the control section prevents the second contact portion 523 from being moved in the upper direction and thus prevents the second cover portion 521 from being opened. Therefore, since the discharge opening 18*d* and the discharge openings 18*a*-18*c* are not opened at the same time, it is possible to prevent colors from being mixed with each other.

A structure of arranging the first contact portion 513 and the second contact portion 523 in the openings 541 of the cover section 54 may be alternatively applied. In the structure, since the first contact portion 513 and the second contact portion 523 are arranged in the openings 541, it is possible to reduce a cross sectional area in a space of each opening from the inside of the cover section 54 to the outside of the cover section 54. Therefore, even if ink enters the inside of the cover section 54, it is possible to prevent the ink from being leaked from the cover section 54 to the outside via the openings 541. In such a case, the first contact portion 513 or the second contact portion 523 may completely cover any one of the openings 541. If the first contact portion 513 or the second contact portion 523 completely covers any one of the openings 541, it is possible to further prevent ink from being leaked via any one of the openings 541 as compared with a case where the openings 541 are not covered. However, even if the first contact portion 513 or the second contact portion 523 does not completely cover any one of the openings 541, it is to be noted that the effect of preventing the ink from being leaked can still be attained.

Although the cover section 54 is provided to cover the first to second opening and closing sections 51, 52 in the present embodiment, the cover section 54 may be not provided. If the cover section 54 is not provided, a cap may be arranged to cover the first to second opening and closing sections 51, 52 and surroundings of the discharge opening 18. The cap can prevent ink from being leaked at opening the discharge opening 18. Since the cap is arranged, it is possible to simultaneously open and close a plurality of exhaust flow passages by only pushing one portion, thereby reducing the number of the pushing sections for pushing the opening and closing sections.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid droplet ejection apparatus for ejecting liquid droplet from a liquid droplets ejection head, comprising:

a plurality of liquid chambers configured to store liquid;

a plurality of liquid supply flow passages configured to supply the liquid from the liquid chambers to the liquid droplet ejection head;

a plurality of discharge openings provided at each of the liquid chambers and configured to discharge bubbles in the liquid supply flow passages;

a first opening and closing section which is able to open and close the discharge openings, and which includes a plurality of first cover portions being able to cover each of the discharge openings, a first contact portion common to and corresponding to the first cover portions, and a first connecting portion connecting the first cover portions with the first contact portion; and a first pushing section configured to push the first contact portion to open and close the discharge openings by moving the first opening and closing section.

2. The liquid droplet ejection apparatus according to claim 1, wherein the first opening and closing section is configured to rotate around a first shaft provided at the first connecting portion.

3. The liquid droplet ejection apparatus according to claim 2, further comprising:

a first biasing section configured to bias the first opening and closing section such that the first opening and closing section maintains a position of covering the discharge openings;

a second opening and closing section which is able to open and close one or more discharge openings different from the discharge openings opened and closed by the first opening and closing section, and which includes a second cover portion being able to cover the one or more discharge openings, a second contact portion common to and corresponding to the second cover portion, and a second connecting portion connecting the second cover portion with the second contact portion;

a second pushing section configured to push the second contact portion to open and close the one or more discharge openings by moving the second opening and closing section; and a second biasing section configured to bias the second opening and closing section such that the second opening and closing section maintains a position of covering the one or more discharge openings, wherein the second opening and closing section is configured to rotate around a second shaft provided at the second connecting portion.

4. The liquid droplet ejection apparatus according to claim 3, wherein the first and second biasing sections are integrally formed as a biasing section, wherein the first opening and closing section is biased by the biasing section in a direction of moving the first opening and closing section to a position of covering the discharge openings and the second opening and closing section is biased by the biasing section in a direction of moving the second opening and closing section to a position of covering the one or more discharge openings.

5. The liquid droplet ejection apparatus according to claim 4, wherein one end of the biasing section is positioned at the first opening and closing section and another end of the biasing section is positioned at the second opening and closing section.

6. The liquid droplet ejection apparatus according to claim 3, wherein the first and second shafts are arranged coaxially.

7. The liquid droplet ejection apparatus according to claim 3, further comprising a cover section covering the first to second opening and closing sections, wherein the cover section comprises a first opening at a region opposite to the first contact portion in the cover section and a second opening in a region opposite to the second contact portion in the cover section.

8. The liquid droplet ejection apparatus according to claim 7, wherein the first and second contact portions are arranged in the first and second openings, respectively.

9. The liquid droplet ejection apparatus according to claim 7, further comprising a cap configured to closely attach with the discharge openings, wherein air in the liquid supply flow passages is suctioned from the discharge openings via the cap.

10. The liquid droplet ejection apparatus according to claim 3, wherein dye ink is liquid stored in the liquid chambers connected with the discharge openings opened and closed by the first opening and closing section, and pigment ink is liquid stored in the liquid chambers connected with the one or more discharge openings opened and closed by the second opening and closing section.

11. The liquid droplet ejection apparatus according to claim 3, wherein color ink is liquid stored in the liquid chambers connected with the discharge openings opened and closed by the first opening and closing section, and black ink is liquid stored in the liquid chambers connected with the one or more discharge openings opened and closed by the second opening and closing section.

12. The liquid droplet ejection apparatus according to claim 2, wherein the discharge opening connected with the liquid chamber storing ink of a color having a high brightness is arranged near the first shaft.

13. The liquid droplet ejection apparatus according to claim 12, wherein the ink of a color having a high brightness is yellow ink.

14. The liquid droplet ejection apparatus according to claim 2, wherein a distance from the first shaft to each of the discharge openings is equal to each other.

15. The liquid droplet ejection apparatus according to claim 1, further comprising a first biasing section configured to bias the first opening and closing section such that the first opening and closing section maintains a position of covering the discharge openings.

* * * * *